United States Patent [19]

Schnoor et al.

[11] Patent Number: 4,829,603

[45] Date of Patent: May 16, 1989

[54] PROTECTIVE SUIT HAVING A ZIPPER OPENABLE WITH A PULL GUIDE

[75] Inventors: Christian Schnoor, Lübeck; Dieter Grönwoldt, Hemmelsdorf, both of Fed. Rep. of Germany

[73] Assignee: Drägerwerk Aktiengesellschaft, Lübeck, Fed. Rep. of Germany

[21] Appl. No.: 131,090

[22] Filed: Dec. 10, 1987

[30] Foreign Application Priority Data

Dec. 10, 1986 [DE] Fed. Rep. of Germany ..... 3642148

[51] Int. Cl.[4] ..... A41D 13/00

[52] U.S. Cl. ..... 2/69; 2/79; 2/82; 2/84; 24/381

[58] Field of Search ..... 2/69, 79, 84, 81, 82; 24/381, 426, 415, 431

[56] References Cited

U.S. PATENT DOCUMENTS

| | | | |
|---|---|---|---|
| 3,337,929 | 8/1967 | McGahee | 24/426 |
| 3,685,814 | 8/1972 | Kawakami | 24/415 X |
| 3,754,306 | 8/1973 | Cirone | 24/431 |
| 4,038,698 | 8/1977 | Smith | 2/82 X |
| 4,272,851 | 6/1981 | Goldstein | 2/82 X |
| 4,275,467 | 6/1981 | Doelter | 2/82 |

OTHER PUBLICATIONS

"Gas Protection Suit 600 PF"; Operating Manual 2536.3, First Edition, Jan. 1980, Drägerwerk AG; Lübeck, Federal Republic of West Germany.

Article entitled "Gasschutzanzüge—Typenauswahl und Konstruktionskriterien," Hans-Joachim Walther, W. German Journal "Drägerheft", No. 312, pp. 5–13, Dated Sep./Dec. 1978.

*Primary Examiner*—H. Hampton Hunter

*Attorney, Agent, or Firm*—Walter Ottesen

[57] ABSTRACT

A protective suit has a zipper defining a pass-through opening with one end of the zipper being led over an indirect path about a region of the body which is not easily accessible by the wearer of the suit. The protective suit is improved so that for the purpose of easier opening, especially in emergency situations, the pass-through opening in the region of the indirect path can be opened by the suit wearer by a one-handed pull movement performed from a location within convenient reach and in any desirable direction suitable to the body. For this purpose, the zipper is provided with a slide on which a flexible pulling means acts which is guided along the indirect path.

5 Claims, 1 Drawing Sheet

PROTECTIVE SUIT HAVING A ZIPPER OPENABLE WITH A PULL GUIDE

FIELD OF THE INVENTION

The invention relates to a protective suit with a zipper defining a pass-through opening with one end of the zipper being over an indirect path around a region of the body.

BACKGROUND OF THE INVENTION

In order to protect the body of a person from harmful effects during activity in a poisoned atmosphere or an atmosphere otherwise enriched with harmful substances, protective suits or hoods suitable for that purpose are known, which can be placed in a gastight and/or watertight manner over the entire body. They are tailored so that even breathing apparatus and/or a breathing mask corresponding thereto can be worn under the protective suit. For stepping into this protective suit, a sufficiently wide opening must be provided for which, for example, a zipper is incorporated into a path guide favorable for this purpose. In order to make it possible to conveniently step into and, after completed use, to make it possible to step out as easily as possible, the course of the zipper must be so designed that unfolding of the open suit is accomplished in as unhindered a manner as possible with the wearer of the suit not coming into contact with the dirtied outer surface. This is particularly necessary when additional equipment must be carried on the body under the protective suit such, for example, as is necessary for use for the rigorous breathing protection for firemen, divers, miners, or also pilots, who need an ABC protective suit.

For the course of the zipper required for the foregoing, there often occur, in addition to straight segments, also curved indirect paths extending around body areas.

A protective suit of this kind is known from the publication "Gas Protection Suit 600 PF", Operating Manual 2536.3, First Edition, January 1980, Drägerwerk AG, Lübeck, Federal Republic of Germany, and is, moreover, described in an article entitled "Gasschutzanzüge-Typenauswahl und Konstruktionskriterien" by Hans-Joachim Walther published in the German journal "Drägerheft", No. 312, pages 5 to 13, September/December 1978.

The known protective suit has a zipper which is led, starting from the right leg side, across the chest to the shoulder and from there transversely across the entire width of the head hood. Other line directions of similar protective suits run transversely on the front side of the suit and are led to the shoulder up to a rearward component region. Special difficulties are encountered when operating the zippers in those sections where they do not run straight but extend along a curved indirect path. There, the slide must be pushed directly by hand. For locations which the suit wearer cannot reach, he thus must bring in another person for assistance. During use, emergency situations may nonetheless arise for which a fast opening, for example, in the head region of the protective suit becomes necessary. Such an emergency can arise in that in the region of the breathing mask, a fit correction must be performed or a fast removal of the breathing mask is necessary, for example, in the case of a suddenly occurring nausea. Such emergencies may however also occur when the suit wearer, because of an irritation in the face area, is prevented from carefully carrying out his activity. He then is anxious to eliminate this irritation or also to effect the correction of the fit of the mask as fast as possible, where he may readily panic if freeing the head region from the protective suit can be carried out only with complications or with outside assistance which is not immediately available. Other regions to which the suit wearer must have access as quickly as possible without the zipper having to be opened in an involved manner are to be found in the vicinity of the breathing apparatus carried on the back.

SUMMARY OF THE INVENTION

In view of the above, it is an object of the invention to improve the protective suit of the kind described above so that particularly in emergency situations, the pass-through opening in the region of its indirect path can be easily opened by the suit wearer from readily accessible places. It is a further object of the invention to provide a protective suit wherein the suit can be opened by a one-handed pull movement in any desired direction suitable to the body independently of the course and position of the indirect path along which a zipper is disposed.

The above object is achieved by providing flexible pull means which acts on the slide of the zipper which is guided along the indirect path.

The advantages achieved by means of the invention lie essentially in that now the indirect path, which does not necessarily have to coincide with the main pulling direction of the zipper of the remaining opening, nevertheless can be opened quickly and completely by a single pulling movement. After opening of the indirect path, access to the uncovered part of the wearer's body or to a piece of equipment is possible without a complex opening of the remainder of the suit. A simple remote actuation of the slide of the zipper is made possible when, in the case of a closed zipper, the slide cannot be reached directly by the suit wearer; and, because of the guide for the pulling means, a simple remote actuation of the slide is possible even over a curved course and in any desired pull direction.

A solution of this kind is also applicable in the same way in the case of garments which enclose the body only partially as, for example, head and shoulder hoods or in similar cases.

A pull cord which runs in a pull guide has proved to be a particularly simple suitable pulling means. At the same time, the pull guide defines the length of the indirect path and provides that a movement of the slide along the indirect path nevertheless occurs also when actuating the pull cord in a diagonal direction.

The pull guide can comprise several individual support and guide locations positioned along the indirect path, the guide locations being in the form of eyelets or also an uninterrupted, slitted connecting link guide wherein the pull cord is accommodated.

For an arrangement of several pull guides along the indirect path, the last pull guide in the direction of the opening is made fixable and the others are displaceable. For a closed zipper, the displaceable pull guides can be positioned along the indirect path in any desired way from the standpoint of their purposefulness with only the last pull guide being fixed at a suitable position of the zipper at the end of the indirect path. For the closed zipper, the pull guides define the course of the pull cord along the indirect path. When opening the zipper, the displaceably arranged pull guides are carried along by the slide of the zipper until they reach the fixed pull guide. Should the zipper be later opened beyond the indirect path, the fixed pull guide can be released, and the zipper slide can be pulled farther along the zipper. Closing the zipper is accomplished in the usual manner wherein the displaceable pull guides must be positioned along the indirect path and the terminal pull guide must be fixed.

A particularly advantageous embodiment of the terminal pull guide can be realized in that it is provided with a blocking detent sliding in the opening direction of the slide. A blocking detent of this kind will be subjected to load in the direction of resistance with a diagonal pull of the pull cord whereby its displacement in the direction toward the indirect path is prevented; yet, it can be readily carried along in the release direction by the opening slide.

A further advantageous embodiment of the fixable pull guide comprises a latching slide having a latch releaseable by the slide or pull guides carried along by the pull cord. In this way, the pull guide will be secured with the aid of a latch, which engages, for example, between the teeth of the zipper. It can be again released in that the pull guides carried along, or also the slide of the zipper itself run upon the actuating element of the latching slide or also overrun the latter and so unlatch the fixable pull guide.

A further simplification of the manipulation is obtained when the indirect path is one end of a zipper which can be opened from two sides. In this way, the indirect path is an access to be opened only in emergencies, wherein for completely stepping out of the protective suit, the remaining, readily accessible portions of the zipper can be opened.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
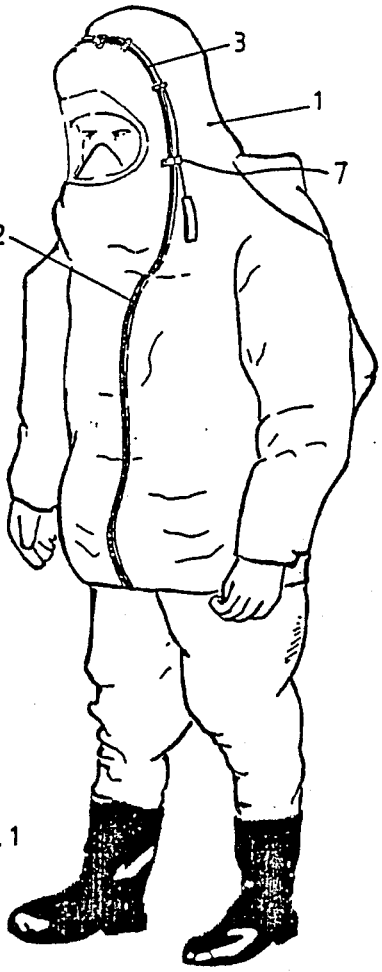
FIG. 1 is a view of a protective suit according to the invention completely covering the body of the wearer thereof.

The protective suit 1 shown in FIG. 1 fully covers the body of the wearer and for that purpose also encloses a breathing apparatus carried on the back. In order for the wearer of the suit to step in and out, a zipper 2 is provided which is led from the side of the right leg over the chest and shoulders and ends in an indirect path 3 which, beginning in the shoulder region, extends over the entire region at the rear of the head.

Figure 2:
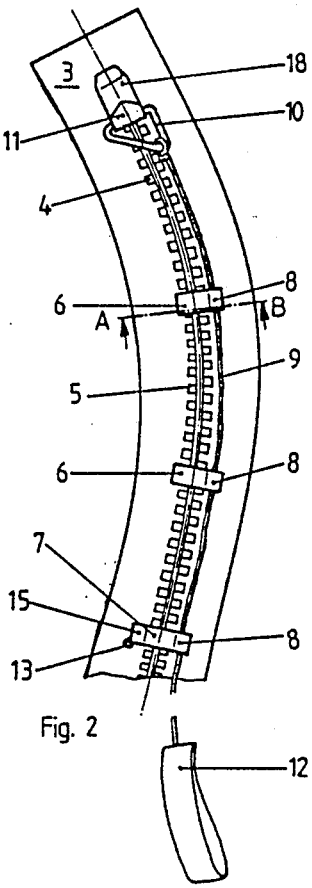
FIG. 2 is a porton of the zipper disposed along an indirect path.

FIG. 2 shows the indirect path 3 of the zipper 2. The closed track 4 of the indirect path 3 is held together by hooked-in locking teeth 5 and is terminated with an end piece 18. A plurality of displaceable pull guides 6 are mounted along the track 4 and a fixable pull guide 7 defines the lower end of the indirect path 3. The pull guides 6 each have an eyelet 8 defining a channel 16 in which a pull cord 9 is guided. The pull cord 9 is attached to a shackle 10 of a slide 11 and, at its other end, is provided with a pull loop 12 for the wearer of the suit to grasp when opening the suit along the indirect path. The fixable pull guide 7 has a blocking detent 13 which is movably pressed about the axis 15 under the force of a spring 14 against the locking teeth 5. The pull guide 7 is the same as the other pull guides 6 except that it is equipped with the blocking detent 13 and spring 14 corresponding to the latter.

Figure 3:
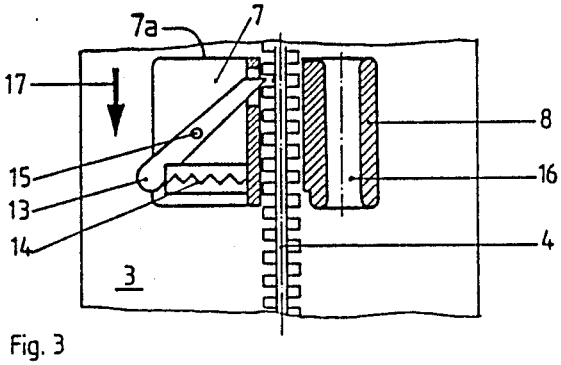
FIG. 3 is a plan view, partially in section, of a fixable pull guide.

The fixable pull guide 7 is more closely shown in FIG. 3. It carries on one side of the track 4 the eyelet 8 shown in cross section through the channel 16 in which the pull cord 9, not shown, is passed. On the opposite side of the track 4, the blocking detent 13 is pressed by the spring 14 against the teeth 5. The blocking detent 13 thus forms at its contact point with the teeth 5 an acute angle in the direction of opening (shown by the arrow 17).

The pull guide 7 can thus slide in the opening direction 17 with the trailing blocking detent 13. A displacement in the opposite direction is possible only when the blocking detent 13 is lifted from the teeth 5 by pressure at its actuating end where spring 14 acts.

When the wearer of the suit pulls on the pull loop 12, the slide 11 is pulled in the direction of arrow 17 and the respective guides 6 stack up one behind the other and engage the fixable pull guide 7 at the end face **7*a*** thereof.

The individual guides 6 are held in position along the length of the indirect path segment 3 by the material of the suit itself pressing lightly against the guides. Thus, and referring to FIG. 4, the material **3*a* of the suit when worn is uneven and is in contact with the peripheral edge 6*a* of the guide 6 and so prevents the guides 6 from sliding down toward pull guide 7 under the force of gravity. On the other hand, all of the guides 6 could be equipped with a detent such as shown for pull guide 7 thereby making it unnecessary to rely on the contact of the suit material on the guides 6** to hold the latter in place while the suit is on the wearer.

Figure 4:
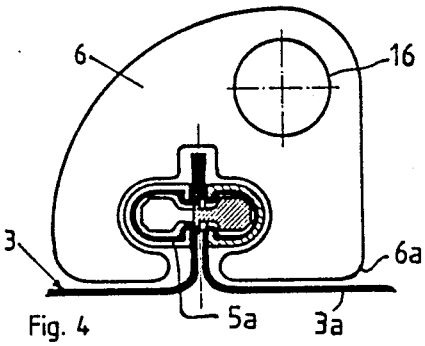
FIG. 4 is a side elevation view of one of the pull guides of the zipper viewed in the direction of line A-B of FIG. 2.

Also in FIG. 4, reference numeral **5*a* designates a metal clamp for holding the teeth 5** in the suit material.

The sliding attachment on the zipper is obtained for the pull guides (6, 7) similarly as for the slide 11 in that the guides engage under the lower profile of the individual teeth 5 as shown in FIG. 4.

It is understood that the foregoing description is that of the preferred embodiments of the invention and that various changes and modifications may be made thereto without departing from the spirit and scope of the invention as defined in the appended claims.

What is claimed is:

1. A protective suit comprising:

a suit for protecting the body of the wearer; and, a zipper for providing a pass-through opening through which the wearer can geth into and out of the suit;

said suit having a suit portion which protects a region of the body that is relatively inaccessible to the wearer;

said zipper having a segment length extending from the end of the zipper along an indirect path on said suit portion so as to be arranged about said region of the body;

said zipper including: disengageable attachment means extending along the length of the zipper for holding said opening closed when the zipper is closed; and, a slide moveably mounted on said attachment means for moving in an opening direction for disengaging said attachment means to open the zipper and for engaging said attachment means when said slide is moved in the opposite or closing direction; and, said zipper further including: flexible pull means for acting upon said slide for moving the latter along said segment length; and, guide means for guiding said flexible pull means along said indirect path.

2. The protective suit of claim 1, said flexible pull means being a pull cord attached to said slide; and, said guide means being a guide for guiding said pull cord along said indirect path.

3. The protective suit of claim 1, said flexible pull means being a pull cord; and, said guide means including: a plurality of intermediate guides for guiding said pull cord along said indirect path, said guides, being displaceably mounted along said indirect path; and, a terminal guide disposed farther away from the end of said segment length than said plurality of intermediate guides, said terminal guide having fixing means for releasably fixing said terminal guide at a position along the length of said zipper.

4. The protective suit of claim 3, said fixing means being a resiliently biased blocking detent mounted on said terminal guide so as to glide on said attachment means when moved in said opening direction and for latching said terminal guide when moved in said closing direction.

5. The protective suit of claim 3, each of said intermediate guides having fixing means for releasably fixing the same at a position along the length of said zipper.

* * * * *